US005504497A

United States Patent [19]

Li

[11] Patent Number: 5,504,497

[45] Date of Patent: Apr. 2, 1996

[54] METHOD AND DEVICE USING ELECTRON BEAM TO SCAN FOR MATRIX PANEL DISPLAY

[76] Inventor: Weicheng Li, ECE Dept., New Jersey Institute of Technology, Newark, N.J. 07102

[21] Appl. No.: 228,816

[22] Filed: Apr. 18, 1994

[51] Int. Cl.[6] ..... G09G 3/28

[52] U.S. Cl. ..... 345/60; 345/62

[58] Field of Search ..... 345/60–64, 74, 345/80, 81, 104, 207; 315/169.4

[56] References Cited

U.S. PATENT DOCUMENTS

| | | | |
|---|---|---|---|
| 3,947,842 | 3/1976 | Hilsum et al. | 345/81 |
| 4,010,321 | 3/1977 | Kohashi | 345/64 |
| 4,553,143 | 11/1985 | Lustig | 345/80 |
| 4,577,189 | 3/1986 | Adolfsson et al. | 345/104 |
| 4,716,406 | 12/1987 | Shionoya | 345/60 |
| 5,036,317 | 7/1991 | Buzak | 345/74 |

*Primary Examiner*—Tommy P. Chin
*Assistant Examiner*—Gin Goon

[57] ABSTRACT

A new scanning method and device for matrix panel display for using electron beam to scan comprising the steps: connecting each anode of dc matrix display panel to the display supply's anode via a switch cell whose status is controlled by electron beam, using one electron beam to irradiate to some anode; using another electron beam to irradiate to some cathode of the display panel; thereby selecting the unique display cell at the intersection of anode and cathode to light up; deflecting both beams accordingly to implement two-dimensional addressing; and adjusting beam current of the irradiating cathode to achieve image gray scale adjustment. The device using electron beam to scan for plasma matrix panel display, comprising a direct-current plasma display panel a plurality of display discharging cells formed at the intersections of the anodes and cathodes and switch cells formed at the intersections of the anodes and collection electrodes; two electron beam scanning, each comprising an electrode-any target screen where target electrodes are connected to display panel's anodes and cathodes, display supply whose output voltage is greater or equal to than the sum of the breakdown voltage of display discharging cell and the ionizing voltage of switch cell; and delay-circuit for longer pixel duty cycle. One electron beam seems anodes and closes the related switch cells to link display supply; another electron beam scans cathodes to make a unique moving display cell to emit light so as to realize two dimensional scanning and display.

15 Claims, 2 Drawing Sheets

METHOD AND DEVICE USING ELECTRON BEAM TO SCAN FOR MATRIX PANEL DISPLAY

TECHNICAL FIELD

The present invention relates to a scanning method and its based device for panel display and more particularly to an electron beam-matrix scanning method and its based device for matrix panel display.

BACKGROUND OF THE INVENTION

Matrix display panels are important display devices in today's electron display area. They have a wide application scope in computers, data control, information processing, communication, aerospace, television, and movie. Currently, the main difficulty and technical barrier in developing matrix panel displays lies in the over-complex structure of their driving and scanning circuits, which leads to the huge number of components and electrical connections, thereby resulting in extremely difficult fabrication and high cost. The difficulty and complexity are more than the doubled in the applications of larger area displays, color displays, and high-definition displays, thus at present time the application scope of panel display systems is severely limited.

SUMMARY OF THE INVENTION

The present invention aims to provide a new scanning method and the display device, i.e. using electron beam means to replace electron circuits to scan matrix electrodes, which fundamentally reduce the scanning circuitry, substantially reduce the number of components and electrical connections, thereby to achieve high-quality display and lower production cost of panel display systems so as to meet the market need.

In one embodiment, the present invention relates to a matrix scanning method using electron beams. Its steps follows:

supplying an electrical supply having anode and cathode to the dc matrix display panel each matrix anode of the matrix display links to the display supply's anode via an anode switch cell whose on-off status is controlled by a scanning electron beam, said anode switch cells made of uniform material with switching characteristic; one supplying control circuit electron beam (called X-beam) emits electron beam onto a switch cell's control pin to close the switch cell which corresponds to an matrix anode of the matrix display so that this matrix anode is conducting with the display supply's anode; another supplying emitting-light circuit which variation according to pixel value of the image to be shown to every display cell of the display panel electron beam (called Y-beam) emits electron beam onto a matrix cathode of the matrix display so that this cathode is conducting to the display supply's cathode directly through the Y-beam; thereby a display cell at which the matrix anodes and the matrix cathode intersect is uniquely selected and conducting in a driving display-cell loop, thus activated to emit light. The loop is: the display supply's anode—switch cell—matrix anode—display cell—matrix cathode—Y-beam—electron gun shooting Y-beam—the display supply's cathode.

Deflecting accordingly X-beam with electrical and magnetic field deflecting means to shift irradiated matrix anodes to serially close relative anode switch cell, so that each matrix anode of the display panel is serially connected with the display supply's anode; deflecting accordingly Y-beam with electrical and magnetic field deflecting means to shift irradiated matrix cathodes so that each matrix cathode of the display panel is serially connected with the display supply's cathode. Thus, two-dimensional addressing for anodes and cathodes of matrix display panel is implemented by accordingly deflecting the electron beams of both X- and Y-guns.

In the above process, simultaneously controlling the beam circuit intensity of the Y-gun according to pixel value of the image to be shown, thereby to adjust the brightness of the image pixels to achieve scanning and display of the image.

In another embodiment, the invention relates to a direct-current plasma display device using the above-described electron beam-matrix scanning method, comprising a direct-current dot matrix plasma display panel means which comprises a front substrate, a base substrate, supporting spacer between front and base substrates, seals, X-direction anode array, Y-direction cathode array, Y-direction collection electrode, display cells at the intersections of anodes and cathodes, switch cells at the intersection of anodes and collection electrodes, proper discharge able gas inside the display means; an X-direction electron beam scanning means (X-gun) with electrical and magnetic field deflecting means, whose target screen is an array of electrodes which connect anodes of matrix display means one by one; a Y-direction electron beam scanning means (Y-gun) with electrical and magnetic field deflecting means, whose target screen is an array of electrodes which connects the cathode of plasma display panel with a resistor; a delay circuit means for all display cells, its unit is formed by the above mentioned resistor and a capacitor which links Y-gun's target electrode and the collection electrode; a shift switch which controls on-off connection between a collection electrode and display supply's anode; a dc display electrical supply for the display panel means, its output voltage should be greater than or equal to the sum of the breakdown voltage of a display cell and the ionizing voltage of a switch cell; other auxiliary circuit means and electrical supplies.

When the device is working, display supply's anode is connected to some collection electrode via the shift switch, the display supply's cathode is grounded. Both X- and Y-guns are connected to their supplies and control circuits. When both guns are cut off, both anodes and cathodes of the display panel means are in the "floating" status; thereby no display discharging cells are conducting to emit light.

Let the X-gun irradiate to an anode through its connected target electrode, this anode's potential decreases through being charged until the switch cell between the anode and collection electrode is on and conducting with display supply's anode. Now let Y-gun irradiate to a cathode through the resistor; similarly, this cathode's potential decreases through being charged until some display cell is conducting, which is actually the one connected in series with the already conducting switch cell, thereby emits light. Meanwhile, the capacitor in the delay circuit means is kept being charged. The light brightness depends upon the magnitude of the beam current of the Y-gun. Because of the limited voltage across the discharging display cell, the maximum voltage between the scanned cathode and display supply's anode is limited by the sum of the ionizing voltage of the switch discharging cell and the breakdown voltage of the display discharging cell at any time, therefore, the other display cells on the scanned cathode linking to the open switch cells will not be conducting, this guarantees the uniqueness of the display cell selected through scanning. Once the Y-gun deflects to another cathode, the charged capacitor is discharging through the resistor, thereby maintains the discharging at the just selected display cell till the capacitor's effective charges are consumed. The portion of pixel duty cycle due to the delay circuit means depends on the time constant of the resistor-capacitor circuit units and the charges gained by the capacitor during the Y-gun's scanning period.

Because the electrical conduction of any display cell relies upon the conduction of its switch cell, when the delay time of the display cell exceeds the duration when X-gun scans another anode, two or more switch cells can be conducting, which confuses the scanning. To solve this problem, all the anodes are divided in a certain order into a number of sets, denoting the number of sets by m, such that each set has only every other m anodes in the anode array. Each set of the anodes corresponds to a collection electrode; a collection electrode is selected by the shift switch, and only one collection electrode is connected to display supply's anode at one time; the shift switch is synchronized with the X-gun so that the collection electrode linking to the display supply's anode always corresponds to the anode being scanned by the X-gun. Let the delay time due to the delay circuit units be less than m−1 times of the Y-gun's scanning period, each cathode is connected with m delay circuit units, each delay circuit unit's capacitor is connected to a collection electrode one by one, the Y-gun targets only the delay circuit unit whose capacitor is being connected to the display supply's anode when scanning. The above construction makes it impossible both for two switch cells in the same set to conduct simultaneously and for two switch cells in the different sets to be on with the display supply's anode and thus enter the scanning loop simultaneously, therefore, guaranteeing the normal dot-by-dot Scanning of the matrix display.

Assuming that the display supply's output voltage and delay circuit's time constant fixed, the brightness of pixels depends upon the working current of the display cells, i.e. the beam current of the Y-gun. Therefore, the device adopts the current-control method for gray-scale adjustment; through grid control of the Y-gun, the image gray-Scale adjustment is implemented.

Because the electron beam current of the Y-gun is limited, the display supply adopts a relatively high voltage to increase the power for the display cells, and a phosphor layer suitable to emit light at a relatively higher voltage is introduced to increase the display efficiency from power to light.

Color panel displays can be conveniently realized by using different color phosphors and arranging properly the phosphor units in the dot matrix.

The following is an example to describe the present invention further.

DETAILED DESCRIPTION OF THE PREFERRED EMBODIMENT

Figure 1:
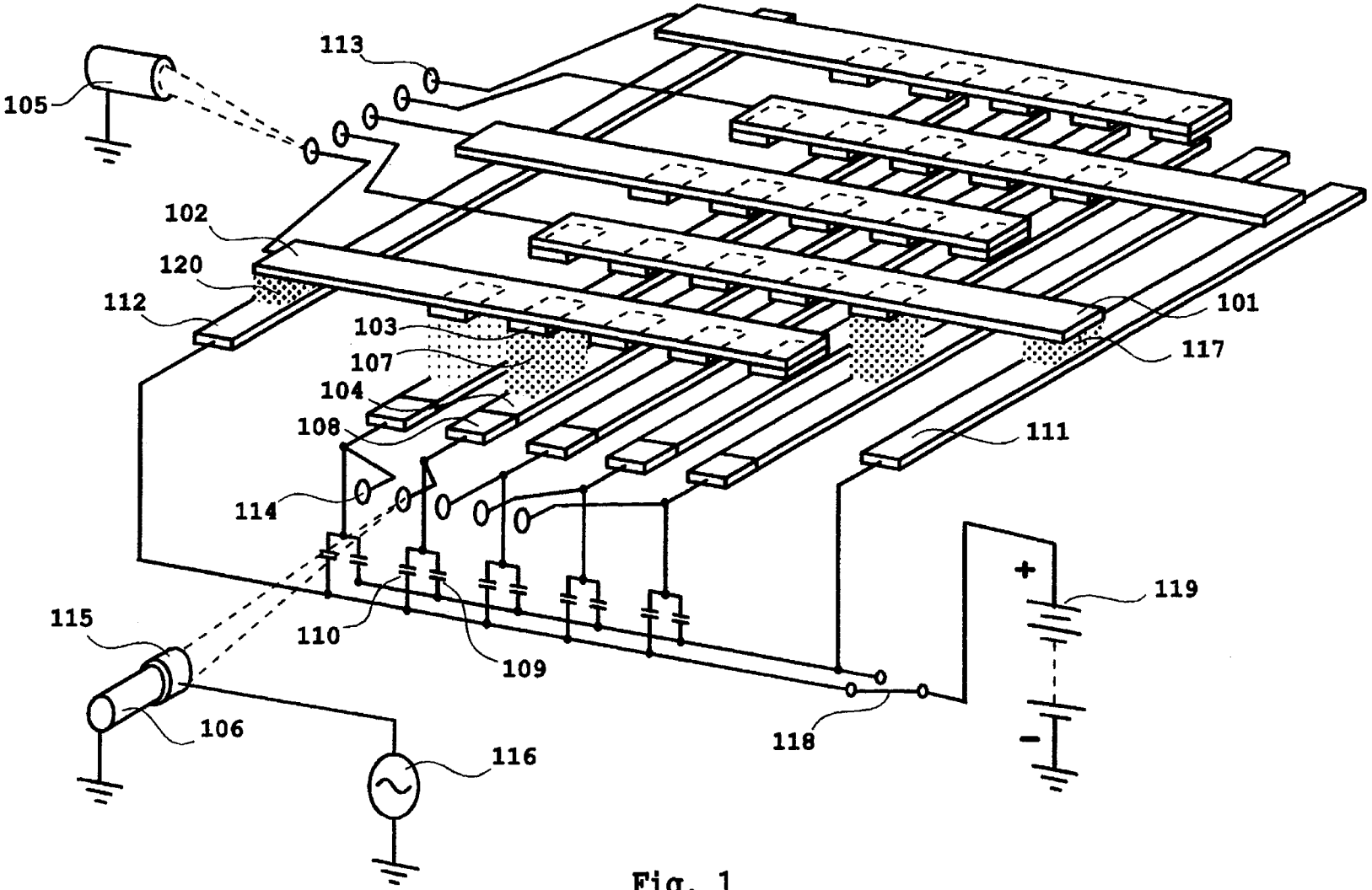
FIG. 1 shows the schematic diagram of the preferred embodiment. The diagram omits the exterior of the panel display and most interior mechanical structure so that its working principle can be illustrated more clearly.

The preferred embodiment is described in detail by referring to FIG. 1.

All anodes partitioned into two sets, odd anodes (101) and even anodes (102) according to odd and even numbers of these anodes are X-direction transparent electrodes in parallel, they are attached onto front substrate (omitted in the FIG. 1), and their interior surface is coated with ion-excited-to-light phosphor units (103). Odd anodes (101) are extended to the fight hand side for a segment of distance, and even anodes (102) are extended to the left hand side for the same segment of distance, the extended portions' interior surface is not coated with phosphor cells.

In the base substrate (omitted in the FIG. 1) corresponding to the extended portion of odd anode (101), there is an odd collection electrode (111) that is space-orthogonal with odd anode (101), and the intersections of the odd collection electrode (111) and odd anode (101) forms an odd switch discharging cell (117), odd collection electrode (111) links to one lead of shift switch In the base substrate (omitted in the FIG. 1) corresponding to the extended port/on of even anode (102), there is an even collection electrode (112) that is space-orthogonal with an even anode (102), and their intersection forms an even switch discharging cell (120), even collection electrode (112) links to another lead of a shift switch (118);

Cathodes (104) are vertical electrodes in parallel, attached onto base substrate (omitted in the FIG. 1), space-orthogonal with anodes (101, 102), and their intersections form display discharging cells (107) corresponding to phosphor cells (103) one by one; one end of each cathode (104) is connected to odd delay capacitor (109) and even delay capacitor (110) through the delay resistor (108). The other ends of all odd capacitors (109) link the odd collection electrode (111), and the other ends of all even capacitors (110) link the odd collection electrode (112).

X direction electron beam scanning means with electrical and magnetic field deflecting means, that comprising X-gun (105) and its target screen that is an array of electrodes has its target electrodes (113) linking to anodes (101, 102) one by one, and its cathode grounded.

Y direction electron beam scanning means with electrical and/or magnetic field deflecting means, that comprising Y-gun (106) and its target screen that is an array of electrodes has its target electrodes (114) linking to the common lead of resistor (108) and capacitor (109, 110) one by one, its cathode grounded, and grid control pin linking to image signal source (116).

A display supply (119) is dc voltage supply for the display panel means, with the output voltage greater than or equal to the sum of the breakdown voltage of said display discharging cell and the ionizing voltage of said switch cell, its anode links to the fixed lead of the shift switch (118), and its cathode is grounded.

The shift switch (118) is synchronized with the X-gun (105) and switches to only one of the collection electrodes to the anode of the display supply (119), corresponding to anode (101) or anode (102) being scanned by the X-gun (105).

The RC time constant of resistor (108) and capacitor (109) or capacitor (110) has the resulting pixel duty delay duration slightly less than one scanning period of the Y-gun (106).

Figure 2:
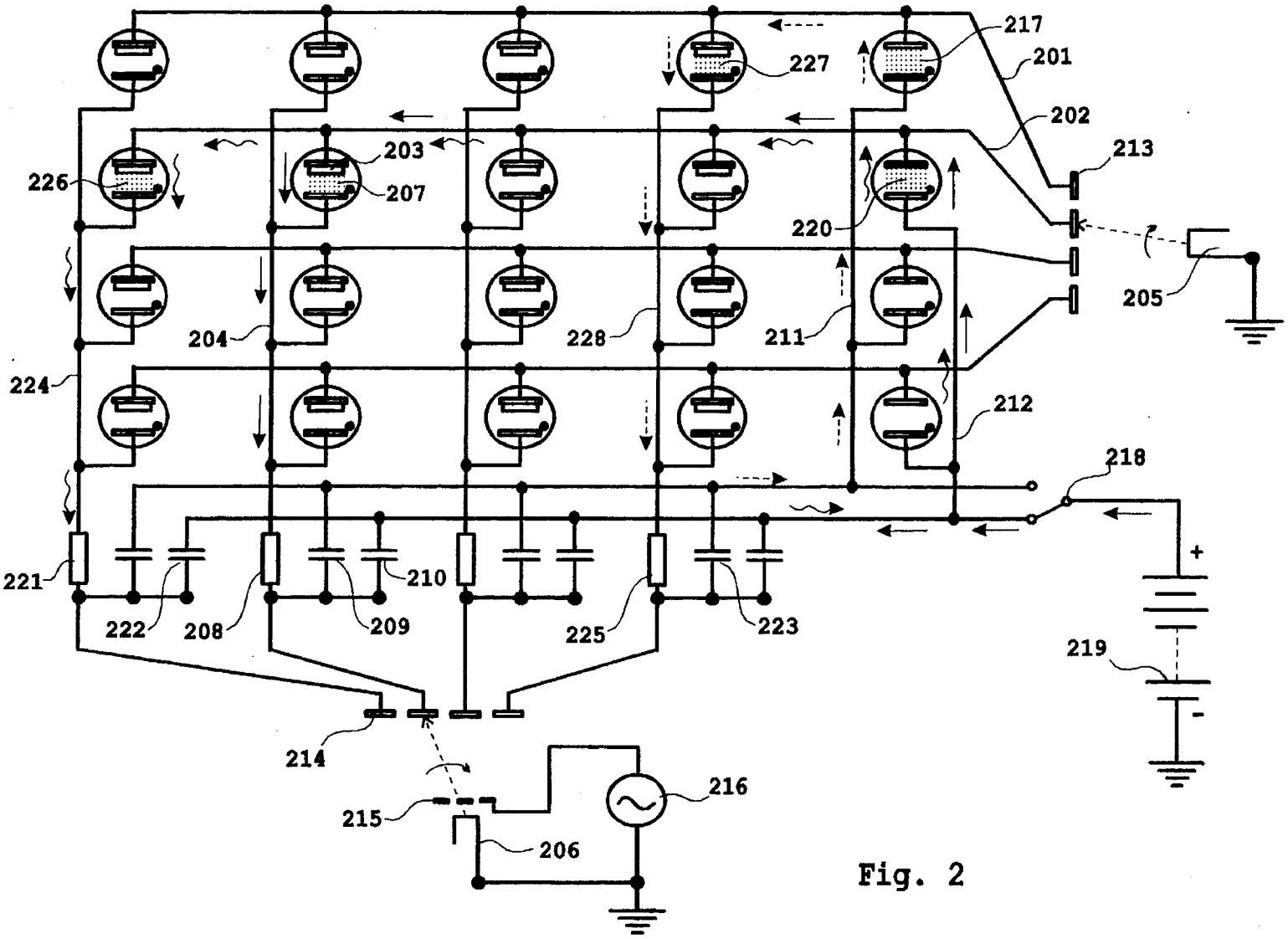
FIG. 2 is the equivalent electrical circuit diagram of the preferred embodiment.

The working principle of the preferred embodiment is described in detail by referring to FIG. 2.

The shift switch (218) connects the anode of display supply (219) to the even collection electrode (212) and X-gun (205) shoots some even anode (202), thereby switch cell (220) is conducting and a relatively small ionizing voltage is maintained between the anode (202) and the anode of display supply (219). When Y-gun (206) shoots cathode (204) through resistor (208), the even delay capacitor (210) connecting to the resistor (208) is being charged. Meanwhile all the display cells on the cathode and their serially related even switch cells are subject to the effect of the output voltage of display supply (219). Because the switch cell (220) has already been on, once the voltage between the cathode (204) and the anode of display supply (219) becomes greater than the sum of the breakdown voltage of the display cell and the ionizing voltage of the switch cell by charging the cathode (204), the display cell (207) connected to switch cell (202) in series is conducting, which decreases the voltage between the cathode (204) and the anode of display supply (219) to the sum of the ionizing voltages of the display cell and the switch cell, resulting in no possibility to increase the voltage to make other display cells conducting, thereby guaranteeing that the display cell (207) is a uniquely selected pixel.

After the display cell (207) is conducting, a portion of beam current of the Y-gun (206) continues to charge the capacitor (210), and the other portion passes through the resistor (208) and display discharging cell (207) to keep ionizing in the cell (207) which produces negative ions to bombard the phosphor unit (203), thus exciting phosphor to emit light; the pixel brightness at the cell (207) and the quantity of charges gained by the capacitor (210) depend on the magnitude of the beam current of Y-gun (206). The current loop is illustrated in FIG. 2 using solid directed arcs (→), i.e. the anode of display supply (219)→shift switch (218)→even collection electrode (212)→switch cell (220)→even anode (202)→display cell (207)→cathode (204)→resistor (208)→Y-gun (206)→ground→the cathode of display supply (219). Meanwhile, the previously just scanned display cell (226) on the same horizontal anode (202) of the current cell illustrated in FIG. 2 using dotted directed arcs (⌒), i.e. the positive charge end of the (207) continues to emit light due to discharging of the even capacitor (222), the current loop is capacitor (222) ⌒ even collection electrode (212) ⌒ switch cell (220) ⌒ even anode (202) ⌒ display cell (226) ⌒ cathode (224) ⌒ resistor (221) ⌒ the negative charge end of the capacitor (222). The display cell (227) at the fight end of the previously X-gun scanned anode (201) continues to emit light due to discharging of the odd capacitor (223), the current loop is illustrated in FIG. 2 using curved directed arcs (--➤), i.e. the positive charge end of the capacitor (223) --➤odd collection electrode (211) --➤switch cell --➤odd anode (201) --➤display cell (227) --➤cathode (228) --➤resistor (225) --➤negative charge end of the capacitor (223).

Although the switch cell (217) is on, the odd collection electrode (211) has been already cut off through shift switch (218) from the anode of display supply (219), thereby odd display cell (227) and switch cell (217) cannot form a loop with the anode of display supply (219), therefore, the odd switch cell (226) can provide the display cell (227) at the "floating" status with a self-supporting current loop only and cannot affect the normal addressing operation, and because the pixel duty delay time due to the delay circuit means is less than the Y-gun's scanning period and two anodes in the same set is separated by at least an anode in the other set, it is impossible for two switch cells of two anodes in the same set to be on simultaneously and to affect each other.

Once Y-gun (206) starts scanning the next cathode's delay circuit unit in order, the next display cell starts the same process as the previously described display (207). Y-gun continues to scan all the cathodes and then returns to the first cathode. During the return process when Y-gun (206) cuts off electron beam, the anode of display supply (219) is connected to odd collection electrode (211) via the shift switch (218) and X-gun (205) deflects quickly to scan the next odd anode to close its switch cell, Y-gun (206) scans the first cathode again, thus starting the scanning of display cells on the next anode. When the next anode scanning is finished, the anode of display supply (219) is connected to even collection electrode (212) via the shift switch (218), X-gun scans the next even anode to close its switch cell, thus starting scanning a new row of display cells on the anode. After scanning a frame, return to the scanning start point of the display panel means to start scanning the next frame.

Two-dimensional scanning for anodes(201, 202) and cathodes(204,224) of matrix display panel is implemented by accordingly deflecting the electron beams of both X-gun(205) and Y-gun(206) with electrical and magnetic field deflecting means. Wherein the shift process from one of anodes or cathodes of the matrix display panel to another only depends on the change of the space position onto where some electron beam is deflected.

In the entire scanning process, image signal source (216) is connected to the grid (215) of the Y-gun (206), controlling the electron beam to implement the image gray scale adjustment.

The phosphor units (203) in the anodes can be designed to emit different color lights, thus proper arrangement of these phosphor units can form a color display array. To this end, Y-gun (206) can be designed to be a synchronized multiple electron beam means, each corresponding to phosphor units of one color and all scanning together, reducing the circuit structure of the color display panel means.

The above described phosphor units can be individually or together with anodes, attached to cathodes, where the cathodes are made of transparent conductive materials. The latter case can realize double-side display.

When pixel duty delay time is greater than a scanning period of the Y-gun (206), but less than (m−1) times of the scanning period (m is a positive integer), the anodes are partitioned into m sets in a certain order such that each set contains every other m anodes, resulting in m collection electrodes correspondingly, each cathode is connected to m delay circuit units, each comprising a resistor and a capacitor, each target electrode in the target screen (214) is connected to the common lead of resistor and capacitor within this delay unit of the cathode one by one, Y-gun (206) irradiates only to the target electrode which links to the capacitor which is conducting with the anode of display supply (219) through the collection electrode.

It is indicated that switch cells connected in the display cell loops do not display and play only the switch role to reduce the power consumption, the ratio of their ionizing voltage to that of the display cells should be kept minimum under the premise that switch cells can reliably work at either on or off status. Next, because the working currents of many display cells need to flow through the switch cell, the switch cell is designed to handle relatively large current and process sufficient small dynamic resistance to avoid the interactions among image signals due to the current path shared by the display cells.

From the above described, the present invention utilizes only two electron beam scanning means and a number of plasma switch cells of a very simple structure to realize conveniently and flexibly two-dimensional scanning, thereby replace a huge number of circuit divers and scanning components in ordinary matrix display systems. One of two electron beam means and a number of resistor-capacitor circuits, together with a shift switch, can implement gray-scale control and longer pixel duty cycle for effective brightness of the image; thereby replace the circuits related to delay, shifting, sampling, memory, switching, and erasure functions which are often needed for an ordinary matrix display using the existing methods. In summary, the present invention's devices have the following advantages:

1. Compared with ordinary matrix flat-panel display systems:

a. The scanning and display circuit structure's complexity is substantially reduced and the number of circuit components and joining leads is much less;

b. Increasing resolution does not increase the complexity of scanning and display circuit structure to a large extent; therefore, the higher clarity display can be realized with low cost;

c. The scanning and image gray-scale control can easily match the present television broadcasting system;

d. The structure is simpler and the production cost is lower.

2. Compared with cathode-ray tube (CRT) devices:

a. There is no need for the high voltage over several thousand volts, thus simplifying the implementation;

b. The number of target electrodes in electron beam scanning is far less the number of pixels in ordinary CRT and thus saves scanning power;

c. The fidelity loss of image is less and linearity is higher;

d. Focus of the entire image is good, and the implementation is simple;

e. The ratio of display area to volume is better and weight is lighter.

What is claimed is:

1. A method using electron beam to scan for dc matrix panel display comprising the steps of:

supplying an electrical supply having anode and cathode to the dc matrix display panel, connecting each anode of matrix display panel to the display supply's anode via an anode switch cell whose on-off status is controlled by a scanning electron beam which changes the voltage between said matrix anode and said display supply's anode; each said anode switch cell is a part of one whole which can only make of uniform material with switching characteristic;

scanning an only supplying controlling circuit to said anode switch cell electron X-beam to irradiate to coupling matrix anode control pin of some said anode switch cell to turn-on said anode switch cell to render said matrix anode conducting to with said display supply's anode through turned-on said anode switch cell;

scanning a supplying emitting-light circuit which variation according to pixel value of the image to be shown to every display cell of said display panel electron Y-beam to irradiate to some cathode of said matrix display panel to render said matrix cathode conducting to said display supply's cathode directly through said Y-beam;

thereby selecting unique display cell at which said matrix anode and said matrix cathode intersect to form a driving display cell loop, thus emit light; said loop is from the display supply's anode—anode switch cell—matrix anode—display cell—matrix cathode—Y-beam—electron gun shooting Y-beam—the display supply's cathode;

deflecting the X-beam and Y-beam accordingly with electrical and magnetic field defecting means to implement two-dimensional matrix scanning of said display panel in the way of space-shifting, wherein the shift process from one of said anodes or cathodes of said matrix display panel to another only depends on the change of the space position onto where said some electron beam is deflected in the above process, simultaneously controlling the circuit intensity of said Y-beam according to pixel value of the image to be shown, thereby to adjust the brightness of the image pixels to achieve displaying of said image.

2. A device using electron beam to scan for plasma matrix display panel comprising direct-current plasma display panel means comprising display discharging cells formed at the space-orthogonal intersections of the matrix anodes and the matrix cathodes, switch discharging cells each of which is a pan of one whole which can be only made of uniform plasma material with switching characteristic formed at the space-orthogonal intersections of said matrix anodes and the collation electrode that parallel with said matrix cathodes and vertical with said matrix anodes;

X direction scanning electron beam means is an electron beam means with the electrode-array target screen, each target electrode in said target screen of X-scanning means being connected to a said matrix anode one by one;

Y direction scanning electron beam means is an electron beam means with the electrode-array target screen, each target electrode in said target screen of Y-scanning means being connected to a said matrix cathode one-by-one;

dc display supply whose output voltage is greater than or equal to the sum of the breakdown voltage of said display discharging cell and the ionizing voltage of said switch cell; said display supply's anode is connected to said collection electrode of said display panel means;

whereby letting said X-scanning means emit electron X-beam to some said target electrode of X-scanning means, to make the potential of said matrix anode which connects to this said target electrode of X-scanning means decreasing down through being charged until said switch cell linking this said matrix anode is on, thereby this said matrix anode is passed through to said display supply's anode;

letting said of Y-scanning means emit electron Y-beam to some said target electrode of Y-scanning means, to make the potential of said matrix cathode which connects to this said target electrode of Y-scanning means decreasing down through being charged until the display discharging cell at the intersection of said matrix cathode and said matrix anode that is already conducted to said display supply's anode is breakdown, thereby said display discharging cell emits light;

deflecting said X-beam and said Y-beam accordingly to implement two-dimensional matrix scanning of said display panel in the way of space-shifting, wherein the shift process from one of said anodes or cathodes of said matrix display panel to another only depends on the change of the space position onto where said some electron beam is deflected in the above process, simultaneously controlling the circuit intensity, of said Y-beam according to pixel value of the image to be shown, thereby to adjust the brightness the pixels of said image to achieve displaying of said image without separate handling, transferring and driving means of said image signal that respectively match the some display cells.

3. The display device as claimed in claim 2, wherein the ionizing voltage of said switch cell after its breakdown is designed to be as much smaller than the ionizing voltage of said display discharging cell.

4. The display device as claimed in claim 2, wherein said switch cell is designed to have capability to work under a much larger current than said display discharging cell.

5. The display device as claimed in claim 2, wherein said switch cell is designed to have as small dynamic resistance value as possible.

6. The display device as claimed in claim 2 wherein said anode selected by said X-gun bas to be conducting before said cathode selected by said Y-gun is conducting when scanning starts.

7. The display device as claimed in claim 2, wherein said Y-gun is designed to offer sufficient beam current to adjust gray scale of pixels.

8. A device using electron beam to scan and adding delay-circuit means for plasma panel display comprising direct-current plasma display panel means comprising transparent anodes partitioned into two sets, either said set containing every other anode corresponding to a collection electrode, display discharging cells formed at the space-orthogonal intersections of said anodes and cathodes, phosphor units attached to said anodes, switch cells formed at the space-orthogonal intersections of said anodes and collection electrodes;

delay means comprising resistor-capacitor delay units linking to said cathodes so that each said cathode links one resistor which in turn links to two capacitors in parallel, two capacitors are connected to two said collection electrodes one by one, X direction scanning electron beam means comprising an electrode-array target screen and an electron beam gun, each target electrode in said target screen is connected to a said anode one-by-one;

Y direction scanning electron beam means comprising an electrode-array target screen and an electron beam gun of a relatively strong beam current, each target electrode in said target screen is connected to a lead of resistor and capacitors within said delay unit of said cathode one-by-one; and each said resistor-capacitor delay unit has its time constant set such that the resultant pixel delay time is less than one scanning period of said Y-beam;

dc display supply whose output voltage is greater than or equal to the sum of the breakdown voltage of said display discharging cell and the ionizing voltage of said switch cell;

shift switch so that it always connects said display supply's anode to said collection electrode corresponding to said matrix anode being scanned by said X-beam;

whereby said shift switch connects said collection electrode corresponding to some said anode to said display supply's anode said X-beam emits electron beam to said anode through electrical conduction of said target electrode so that said anode's potential decreases through being charged until said switch cell linking said anode is on, thereby said anode is passed though to said display supply; let said Y-beam emit electron beam to some common lead of resistor and capacitors within said pixel delay unit through electrical conduction of said target electrode, the said capacitor connecting to mad collection electrode linking to said display supply's anode is charged and said cathode's potential decreases through being charged until a said display discharging cell at the intersection of said cathode and already-conducted said anode to said display supply's anode is conducting; meanwhile, a portion of beam current of said Y-beam continues to charge said capacitor, and other portion of said beam current passes through said resistor Band display discharging cell to drive said cell's ionizing which produces negative ions flying to said anode under the electrical field, and bombarding said phosphor attached on the surface of said anode to emit light;

after said Y-beam deflects to another said cathode, the charged said capacitor is discharging through said resistor, thereby to maintain the ionizing in the just selected said display cell; for the pixel duty delay time is less than said Y-beam scanning period, said display discharging cells and switch discharging cells of different anodes in the same set cannot be conducting simultaneously when scanning the way in which said shift switch selects said collection electrodes ensures that said display discharging cells and switch cells of different anodes in the different sets are never be in a scanning loop simultaneously, therefore, guaranteeing no disadvantageous effects of said delay means on the normal dot-by-dot scanning;

whereby deflect the electron beams of said X-beam and Y-beam according to some scanning rule, thereby change scanned said anodes and/or cathodes to move active pixels;

in the above process, simultaneously controlling the beam current of said Y-beam by the image signal source, thereby to adjust the image gray scale to achieve scanning and displaying of said image.

9. The display device as claimed in claim 8, wherein said switch cells is positioned outside said display discharging cell's matrix within said display panel means.

10. The display device as claimed in claim 8, wherein said display cell's ionizing voltage is designed to be relatively high voltage to increase the display power gained by said display cells.

11. The display device as claimed in claim 8, wherein said pixel duty delay time can be greater than a scanning period of said Y-gun, if it is less than (m–1) times of said Y-gun scanning period, said anodes are partitioned into m sets in a phase-order, resulting in m said collection electrodes, each said cathode is connected to m said delay units, each comprising a resistor and a capacitor, the number of said target electrodes inside said target screen of said Y-gun increases to m times of the number of Mid cathodes, each target electrode in said target screen is connected to the common lead of resistor and capacitors within said delay unit of said cathode one-by-one.

12. The display device as claimed in claim 8, wherein said phosphor is designed as low-power high-brightness phosphor producing different color light, proper arrangement of said phosphor of different color lights in matrix of the said display panel means realizes color display.

13. The display device as claimed in claim 8, wherein said X and/or Y-guns can be designed as a multiple electron beam means.

14. The display device as claimed in claim 8, wherein said X-gun used to scan said anodes can be multiple and said Y-gun used to scan said cathodes can be multiple.

15. The display device as claimed in claim 8, wherein said cathodes can be designed individually or together with said anodes, attached with said phosphor layer, and made of transparent material; the latter case can implement double-side display.

* * * * *